US008898994B1

(12) United States Patent
Socha et al.

(10) Patent No.: US 8,898,994 B1
(45) Date of Patent: Dec. 2, 2014

(54) METHOD FOR SEALING WOOD SUBFLOORS

(75) Inventors: Dennis Albert Socha, Buffalo Grove, IL (US); Raymond A. Kaligian, Geneva, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 13/452,283

(22) Filed: Apr. 20, 2012

Related U.S. Application Data

(60) Provisional application No. 61/477,464, filed on Apr. 20, 2011.

(51) Int. Cl.
*E04B 1/00* (2006.01)
*E04F 15/12* (2006.01)
*E04F 15/18* (2006.01)

(52) U.S. Cl.
CPC *E04F 15/12* (2013.01); *E04F 15/18* (2013.01)
USPC ..... 52/741.4; 52/403.1

(58) Field of Classification Search
CPC ..... E04F 15/12; E04F 15/18; E04F 21/24; B23B 17/10
USPC ..... 52/741.4, 403.1, 408
See application file for complete search history.

(56) References Cited

U.S. PATENT DOCUMENTS

| | | | | |
|---|---|---|---|---|
| 3,795,533 | A | 3/1974 | Lal Gauri | |
| 4,153,743 | A | 5/1979 | Caramanian | |
| 4,274,239 | A * | 6/1981 | Carroll | 52/443 |
| 4,810,748 | A * | 3/1989 | Spells | 524/725 |
| 5,273,787 | A * | 12/1993 | Gnatowski | 427/408 |
| 5,424,099 | A * | 6/1995 | Stewart et al. | 427/397.7 |
| 6,399,181 | B1 * | 6/2002 | Corder | 428/143 |
| 6,586,066 | B1 * | 7/2003 | Buckwalter et al. | 428/40.1 |
| 6,599,599 | B1 * | 7/2003 | Buckwater et al. | 428/40.1 |
| 6,800,353 | B1 * | 10/2004 | Anderson et al. | 428/141 |
| 6,922,963 | B2 | 8/2005 | Simonelli et al. | |
| 7,062,888 | B2 | 6/2006 | Alesi | |
| 7,276,549 | B2 * | 10/2007 | Liu et al. | 524/423 |
| 7,282,264 | B2 | 10/2007 | Ddamulira et al. | |
| 7,886,488 | B2 * | 2/2011 | Payne et al. | 52/144 |
| 7,908,810 | B2 * | 3/2011 | Payne et al. | 52/450 |
| 2007/0238827 | A1 | 10/2007 | Brady et al. | |
| 2009/0214879 | A1 | 8/2009 | Jucker et al. | |
| 2010/0062219 | A1 | 3/2010 | Richards | |
| 2010/0068533 | A1 * | 3/2010 | Chanvillard | 428/428 |
| 2010/0159254 | A1 | 6/2010 | Oertli et al. | |
| 2010/0247929 | A1 | 9/2010 | Oertli et al. | |

* cited by examiner

*Primary Examiner* — Basil Katcheves
(74) *Attorney, Agent, or Firm* — Greer, Burns & Crain, Ltd.; Pradip Sahu; Philip T. Petti

(57) ABSTRACT

A method of applying a flooring system on a wood subfloor, including providing a sealer for direct application to the wood subfloor; applying the sealer to the wood subfloor; and allowing the sealer to dry and cure, forming a sealed and stable wood subfloor.

8 Claims, 2 Drawing Sheets

METHOD FOR SEALING WOOD SUBFLOORS

RELATED APPLICATION

This application claims priority under 35 USC 119(e) from U.S. Patent Application Ser. No. 61/477,464 filed Apr. 20, 2011.

FIELD OF THE INVENTION

The present invention relates to an improved method of sealing wood subfloors, including aged or otherwise dry wood, as part of constructing or renovating flooring systems. More specifically, the present invention relates to the application of a concrete primer for sealing a dry wood substrate against the effects of an adjacent cementitious underlayment that releases water as it cures and dries.

BACKGROUND

The need for moisture barriers for protecting wood from damage in building structures, particularly in flooring systems, is appreciated in the construction and renovation of buildings. One potential problem caused by excessive moisture emission is the lifting and/or separating of the finish floor from the substrate, for example by bubbling, peeling or delaminating. When this happens, a costly replacement of finish flooring becomes necessary to avoid further deterioration, or unsightliness.

Various sources of moisture, such as ground water and moisture from incompletely cured concrete, are known to influence and possibly damage flooring systems. Many polymer-based or polymer-enhanced moisture barriers are known and utilized for abating the negative effects, but moisture persists as a cause of damage to structural components of buildings. Moisture barriers are also known as water, vapor, and condensation barriers.

Epoxy sealers polymer-based compositions customarily used to provide a protective film that adheres to an upper exterior of a concrete substrate. For example, water-borne epoxy moisture vapor treatments, such as SIKAFLOORS® Fast Track Primer ("FTP") (Sika Corp., Lyndhurst, N.J.), are utilized for preventing moisture damage to toppings and finish floor surfaces from seepage or emission (water, moisture or vapor) through a concrete subfloor. SIKAFLOOR® FTP concrete primer was originally developed by Valspar Federated Flooring Division as a moisture mitigation system for concrete subfloors where the moisture vapor emission rate is between 3 lb/1,000 $ft^2$ (0.01 $kg/m^2$)-8 lb/1,000 $ft^2$ (0.04 $kg/m^2$) per 24 hrs. This product is designed specifically for application to concrete subfloors as a water vapor treatment material that will then be over-layed, possibly by epoxy or urethane coatings, underlayments and floor coverings. Older concrete floors must be shot-blasted to open the surface to allow penetration of the FTP. Under adverse conditions, it is likely that a topical film, such as that formed by an epoxy or non-breathing floor covering, will peel, bubble and detach from the surface, becoming a "floating layer", which can lead to more problems with adhesive application and finish floor installation.

Cementitious underlayments are desirably used for leveling an uneven subfloor before installing a finished flooring material such as ceramic tile, hard wood, vinyl or wood laminate, as known in the art. However, most conventional cementitious underlayments cannot be used with wood subfloors. One class of cementitious underlayments are non-gypsum materials such as Portland cement—or High Alumina Cement—based materials, and they may require shot blasting because of their propensity to shrink during the curing cycle. Gypsum based pourable underlayments, however, are gaining popularity. The pourable underlayment involves an uncomplicated installation process that includes pouring and spreading gypsum based cement that is mixed on the job site with sand and water until a pourable slurry is obtained. Such a cement is also known as gypsum concrete. The slurry is poured in place and screeded to the desired thickness and smoothness. The gypsum concrete sets and becomes a usable, walkable surface within hours. However, excess water is still present and may take days or weeks to be released from the gypsum cement based underlayment, depending on pour depth and drying conditions.

One of the benefits of a gypsum concrete floor is its resistance to cracking. Gypsum concrete will expand slightly as it goes through the setting and drying process. However, when the flooring substrate is wood, such as dry wood which is commonly found in buildings being renovated, this crack resistance may be compromised because moisture may be wicked away from the gypsum underlayment during the application stage and absorbed into the wood, causing the wood to swell. Because gypsum concrete is not a structural material, the differential movement due to the swelling results in stresses which may cause cracking of the underlayment. Cracks that appear in the underlayment may telegraph through and cause imperfections in the finished floor.

LEVELROCK® pourable underlayment is a pourable gypsum based and self-leveling underlayment commonly utilized between a wood or cement subfloor and a variety of finished floor overlays. As this underlayment sets and dries, excess moisture or "free water" which is that amount of water beyond what is used in the chemical reaction that is the setting process is released. This free water which is required to allow the underlayment to flow properly can be absorbed into the subfloor materials, especially dry wood that is common in aged buildings being renovated. When this absorption occurs, the substrate (subfloor) will swell as the underlayment is hardening and setting in place. The undesirable result is that the underlayment may crack as the subfloor swells and moves at a different rate than the gypsum underlayment. Moisture vapor barrier fabrics, such as MOISTOP® vapor barrier (Fortifiber Building Systems Group, Femley, Nev.), have been placed on top of a subfloor before placing an underlayment. However, different jobs or projects may not always allow for use of such fabrics.

Another consideration is that a dry wood subfloor will absorb or "rob" water from the gypsum underlayment, the water that is intended to aid in the flow of the underlayment. When this occurs, the technician responsible for final smoothing of the floor will have difficulty in achieving a smooth underlayment surface. To overcome this problem, the technician will call for the addition of more water to the mix. This addition of water is expected to be above and beyond the underlayment manufacturer's recommendation and can cause a loss of compressive strength. The gypsum crystals become spread out or displaced, for example, by air bubbles left behind after the added water evaporates. The loss of compressive strength compromises the performance or strength of the floor.

Aqueous emulsion polymer mixtures, such as LEVELROCK™ Floor Primer, LEVELROCK™ Concrete Primer, LEVELROCK™ All-Purpose Sealer or DUROCK® Primer-Sealer high solids sealant (United States Gypsum Co., Chicago, Ill.) have been applied as films or layers that sit on the surface of substrates, including concrete, wood and wood structural panels, with the goal of sealing a highly porous surface. Otherwise, an underlayment installed over the subfloor would not be satisfactorily smooth.

A waterborne latex material, such as acrylic, polyvinyl acetate, polyvinyl alcohol, styrene butadiene, and others known in the art, has also been applied as a film or surface layer to cement and wood substrates as an adhesive or a primer for overlay materials. The latex acts as a primer between a substrate and an overlay. When used, this primer allows for little to no surface preparation before applying the overlay, thereby providing efficiencies as described in U.S. Patent Application Publication No. 2010/0062219.

U.S. Pat. No. 6,399,181 discloses formation of a non-skid mat for surfaces such as garage floors that are at risk of becoming slippery when exposed to fluids such as water or oil. A wood substrate is coated with a thermosetting epoxy resin material. The coated wood substrate is further coated, or laid over, with cloth that has been dipped in an epoxy resin and an amine hardener, possibly the same epoxy as that utilized to coat the wood. To this assembly a third coating is applied, to which is added a granular material such as crushed walnut shells. This tri-coated wood substrate forms a base that is dried and then fastened to a conventional rubber mat by conventional attachment means, such as GORILLA GLUE® adhesive to create a non-skid, water-resistant, oil-resistant surface structure.

U.S. Pat. No. 3,795,533 discloses the preservation and strengthening of porous solid objects, including wooden objects, by sequential impregnation with a plurality of solvent mixtures containing concentrations of curable, hydrophobic, polymeric materials, including epoxides. The solvents utilized may be hydrophilic or hydrophobic. Hydrophilic solvents include dimethylsulfoxone, the aliphatic and aromatic alcohols, the ketones, dioxane, or glycol ethyl ether. Suitable hydrophobic solvents include benzene, toluene, xylene, or mixtures of any of these. Selection of the solvent has an effect on the depth to which the treatment will penetrate the pore. Before impregnating the pores with the polymer composition, the surface of the porous solid to be treated may first be washed by conventional means to remove gross contaminants. The porous solid is then treated sequentially with water-solvent mixtures of increasing solvent concentration. The final treatment is with the solvent alone, to prepare the solid for further impregnation with the polymer-solvent solution. This is a cleaning treatment that removes any water-soluble impurities or any residual water moisture from the pores, and further permits the subsequently applied polymer to be synergistically penetrated deeper into the pore system. Impregnation of the polymeric material after the solvent treatment enables the polymeric material to penetrate as deeply as the capability of the absolute solvent to enter the pore space. In pores of less than one micron in size, when using acetone as the solvent, penetration of the solvent to a depth of about one inch is possible after about ¾ of an hour. Following the cleaning, this method teaches sequential application of curable polymeric compositions of varying/increasing polymeric material concentrations. While the process of first cleaning the pores with solvent is not required, it is recommended to aid the deeper penetration of polymeric compound. One to ten sequential polymeric material applications are recommended, but if only one polymeric treatment is applied, it must be preceded by at least one solvent/cleaning treatment as described above.

The recommended practice for applying FTP sealer to concrete floors is to shot-blast or scurify the concrete floor prior to application of the FTP sealer. This is typically done in almost all concrete surfaces to remove any densifiers or a concrete curing agents that would affect the performance of the FTP sealer and to open up the pores of the concrete surface. The exception to this is a fresh concrete surface that is less than forty-eight (48) hours old.

SUMMARY

Surprisingly, utilizing an epoxy resin sealer that is conventionally utilized on concrete, such as SIKAFLOOR® Fast Track Primer ("FTP") concrete sealer, or similar epoxy system, has been found to improve a flooring system when applied over a wood subfloor and fulfills the building construction and renovation industry need for a method of preparing a wood subfloor, including dry wood, prior to finishing the floor. An advantage of the presently claimed method is that cost savings can be achieved by diluting the concrete primer, presently utilized as a wood sealer, beyond the manufacturer's recommended dilution rate for when the material is utilized as moisture vapor remediation on concrete floors. The present method of sealing a wood subfloor is also less labor intensive than conventional methods, especially for dry wood. Another advantage is that a lower quantity, as measured by thickness, of the gypsum-based underlayment may be utilized to achieve the same effectiveness of the same underlayment when utilized without the present sealer on the wood subfloor. This can accelerate the drying process and provide scheduling flexibility.

A method of applying a flooring system on a wood subfloor is provided. The method includes providing a sealer for direct application to the wood subfloor, applying the sealer to the wood subfloor, and allowing the sealer to dry and cure, forming a sealed, stable wood subfloor.

DETAILED DESCRIPTION

A method is provided for utilizing an epoxy resin sealer, such as SIKAFLOOR® Fast Track Primer ("FTP") concrete sealer, or similar epoxy system, optionally with an underlayment, over a wood substrate. It is believed that the wood substrate is stabilized by the present low viscosity, waterborne epoxy sealer, which allows the wood to generally maintain its pre-application dimensions, and not swell unacceptably. Water from the environment, including any cementitious underlayment that may be placed between the subfloor and the finish floor, is appreciably prevented from passing into the wood. Therefore, the wood does not appreciably swell and movement between the floor underlayment or topping and the subfloor is reduced. This reduces the likelihood of cracking of the underlayment or finish floor.

Figure 1:
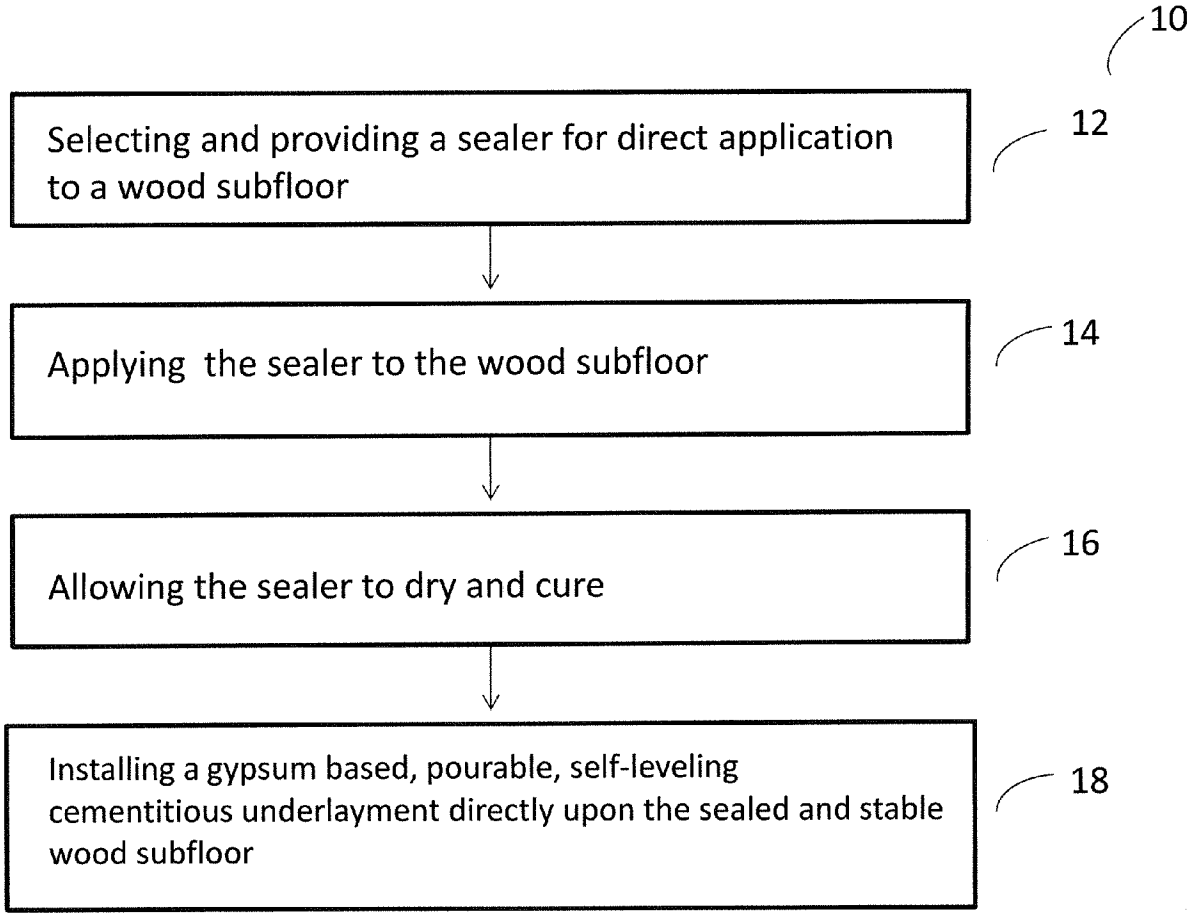
FIG. 1 is a flowchart of the present method of applying a flooring system on a wood subfloor.

As illustrated in FIG. 1, a method (10) is provided for applying a flooring system upon a wood subfloor, including a step (12) of selecting and providing a sealer for direct application to the wood subfloor, a step (14) of applying the sealer to the wood subfloor, and a step (16) of allowing the sealer to dry and cure. Optionally, a further step (18) may include installing a gypsum based, pourable, self-leveling cementitious underlayment directly upon the sealed and stable wood subfloor.

Figure 2:
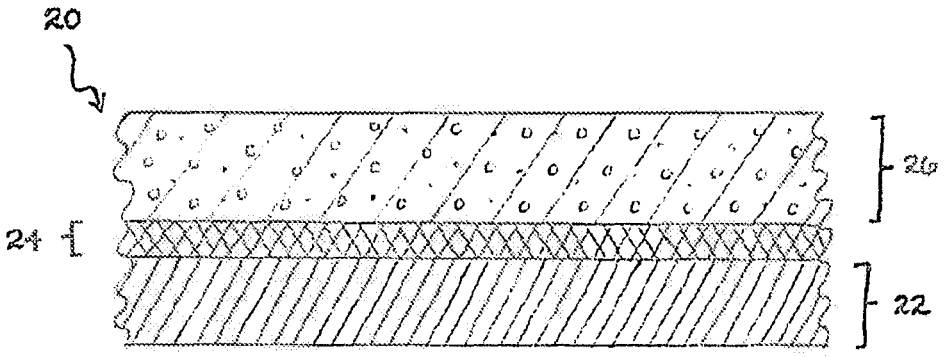
FIG. 2 is a schematic vertical section of the flooring system.

As illustrated in FIG. 2, a flooring system generally designated as 20, includes a wood subfloor 22, a sealer layer 24 disposed upon the wood subfloor 22, and a gypsum based, pourable, self-leveling cementitious underlayment 26 disposed directly upon the sealer layer 24.

The present method is particularly well suited for a wood subfloor that is plank board or any wood that is dry, due to age or other conditions. Dry wood subfloors, such as wood planks, are commonly found in buildings being renovated, such as urban factories and warehouses that are converted to residential living spaces.

Surprisingly, an epoxy concrete primer has been found to reduce swelling, movement and damage to a flooring system where a cementitious underlayment is installed over a wood substrate. The concrete primer is utilized as a wood sealer with surprising success. Without being bound by theory, the inventor believes this result is achieved due to the low viscosity of the epoxy sealer allowing it to penetrate into the wood substrate. Optionally, the penetration is complete and no material remains on the substrate surface to form a film. Preferably, the sealer is a water-based emulsion, also known as a water-borne epoxy based material. More preferably, the sealer is SIKAFLOOR® Fast Track Primer ("FTP") (Sika Industrial Flooring, Lyndhurst, N.J.) which is designed for priming cement subfloors for the purpose of providing a moisture vapor barrier treatment over the subfloor and under the overlay coating systems. Where moisture vapor barriers are usually employed to limit damage from water emanating from the substrate or below, FTP has been discovered to be effective in reducing damage related to water or moisture traveling the opposite direction: emanating from a cementitious underlayment to a substrate, especially a wood substrate.

SIKAFLOOR® FTP concrete primer is a water-borne epoxy coating with three components: hardener (Part "H"), resin (Part "R") and water. A desirable feature of the present sealing method is that the epoxy based wood floor sealing material is diluted to obtain a low viscosity. Optionally, it is super-diluted, as described below. The cost of this system, if the sealer is applied at the manufacturer's recommended rate, would make this method for sealing a wood floor economically unfeasible. However, the present system provides for higher dilution ratios. In one embodiment, the SIKAFLOOR® FTP primer material is mixed according to manufacturer's directions, providing a standard dilution. Optionally, the standard dilution is further diluted with 3 parts water to 1 part standard mixture. Optionally, 5 parts water to 1 part standard mixture is provided. Solids content, on a dry solids basis, of the standard SIKAFLOOR® FTP primer mixture is approximately 33%. The 3:1 diluted mixture is approximately 12.5% solids, and the 5:1 dilution is approximately 9.0% solids, all on a dry solids basis. The present material can be rolled on or spray applied at the rate of 400 $ft^2$/gallon (37 $m^2$/3.8 L). Viscosity of the mixture decreases as the dilution increases. For example, viscosity of a standard dilution SIKAFLOOR® FTP primer mixture was measured to be 40 cps (0.04 $N*s/m^2$), while a 3:1 diluted mixture measured 11 cps (0.011 $N*s/m^2$).

Viscosity of the present sealer was measured using a Brookfield DV-II+ Programmable Viscometer. The Brookfield Viscometer is of the rotational variety. It measures the torque required to rotate an immersed element (spindle) in a fluid. The spindle is driven by a motor through a calibrated spring. Deflection of the spring is indicated by a pointer and dial, or by a digital display. By utilizing a multiple speed transmission and interchangeable spindles, a variety of viscosity measurements can be made. Described as a unit of dynamic viscosity, centipoises is the amount of force necessary to move a layer of liquid in relation to another liquid. Centipoises is considered the standard measurement for fluids of all types. It is one hundredth of a poise. The symbol for centipoises is cP or cps.

In the present method, the sealer is applied directly to the wood substrate. No moisture vapor fabric is required. No surface preparation, other than removing debris, preferably by sweeping, is required. However, if there is a slight amount of residual dust or dirt remaining after removal of the debris, the present sealer will help bond this to the surface of the substrate, thus minimizing any bonding issues that might occur because of poor cleaning. Application of the sealer is accomplished by spraying, rolling, pouring, spreading or a combination of any of these or other conventional application methods and is accomplished by utilizing any standard or known tools or equipment known in the field (pouring, rolling, applying/spreading by broom or spraying). Penetration of the pores of the substrate by the sealer allows the sealer to adhere to or settle on the surface of the pores, cracks and other openings in the substrate or subfloor. It is desirable that insufficient epoxy material remains on the surface to reduce or avoid formation of a film. The presently described method accomplishes this result in a labor and cost saving way. With the present method, washing or chemical cleaning with a solvent is not required for removing residual epoxy material.

As known in the field, the water-borne epoxy sealer is sold in two parts, a resin and a hardener, that are mixed at the job site. The mixed parts form the sealer, which is applied, as described above, within the designated pot life of the sealer. For example, SIKAFLOOR® FTP concrete primer has a pot life of two hours. Allowing the sealer to dry and cure is desired before application of the underlayment. Curing, or setting, involves individual resin molecules cross-linking to form larger, stronger molecules. Eventually, the molecules bond to the surface of the substrate pore and harden in place. Thus, the cured polymeric material enhances the wood. Additionally, because the pores on the surface of the wood are filled with polymer, they cannot fill with water, and the wood will not absorb water from the gypsum-based underlayment that is placed upon it.

Once cured, the sealed substrate is ready to optionally receive the pourable, self-leveling cementitious gypsum based underlayment. In one embodiment, the underlayment is one of LEVELROCK® 2500 and LEVELROCK® 3500 underlayment. In some embodiments, the underlayment has a compressive strength of at least 3500 psi (250 kg-force/$cm^2$). For example, LEVELROCK® 4500 NXG underlayment has a minimum compressive strength of 4500 psi (320 kg-force/$cm^2$), and LEVELROCK® CSD Early Exposure and LEVELROCK® Ultra Armour underlayment has a minimum compressive strength of 3500 psi (250 kg-force/$cm^2$).

Optionally, LEVELROCK® underlayment is utilized in the present method at a thickness between 0.64 cm-1.9 cm (¼ and ¾ inch), although this can vary depending on job conditions. This thickness is more efficient than that of conventional procedures, where cementitious underlayment is customarily utilized at a 2.5 cm (1 inch) thickness. It is believed that the present invention is most useful at the described thicknesses, as the thickness has an effect on the smoothness and crack resistance of the underlayment. LEVELROCK® underlayment is also known to be used in much thicker, "deep fill" situations at 5 cm, 7.5 cm, and 10 cm (2, 3 and 4 inch) thicknesses. Deep fills are employed when all or part of a subfloor is considerably out of level. This can often happen during rehab or renovation jobs as settlement of, or modifications to the building make for variances in subfloor elevations.

While particular embodiments of the present method of sealing a wood subfloor have been shown and described, it will be appreciated by those skilled in the art that changes and modifications may be made thereto without departing from the invention in its broader aspects and as set forth in the following claims.

What is claimed is:

1. A method of applying a flooring system on a wood subfloor, comprising:

providing a sealer for direct application to the wood subfloor, wherein the sealer is a water-borne epoxy coating with viscosity no more than 11 cps, wherein the coating is obtained by mixing together water, resin and a hardener;

applying the sealer to the wood subfloor by at least one of spraying rolling, pouring and spreading;

allowing the sealer to air dry and cure, forming a sealed and stable wood subfloor; and installing a gypsum based, pourable, self-leveling underlayment directly upon the sealed and stable wood subfloor by pouring the underlayment and allowing it to self-level, wherein the method is performed without a moisture vapor fabric.

2. The method of claim 1 wherein the wood subfloor is a wood plank board.

3. The method of claim 1 wherein the gypsum based underlayment is installed and configured to have a thickness between 0.64 cm and 1.9 cm thick.

4. The method of claim 1 wherein the sealer provided is SIKAFLOOR® Fast Track Primer sealer.

5. The method of claim 4 further comprising diluting the SIKAFLOOR® Fast Track Primer sealer with water to provide a diluted sealer mixture for direct application to the wood subfloor.

6. The method of claim 5 wherein the diluted sealer mixture is about 12.5% solids.

7. The method of claim 5 wherein the diluted sealer mixture is about 9% solids.

8. The method of claim 1 wherein the underlayment is one of LEVELROCK® 2500 and LEVELROCK® 3500 underlayment.

* * * * *